US010889871B2

(12) United States Patent
Takajo et al.

(10) Patent No.: US 10,889,871 B2
(45) Date of Patent: Jan. 12, 2021

(54) METHOD OF MANUFACTURING GRAIN-ORIENTED ELECTRICAL STEEL SHEET EXHIBITING LOW IRON LOSS

(71) Applicant: JFE STEEL CORPORATION, Tokyo (JP)

(72) Inventors: Shigehiro Takajo, Tokyo (JP); Masanori Uesaka, Tokyo (JP); Kazuhiro Hanazawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 893 days.

(21) Appl. No.: 14/439,112

(22) PCT Filed: Oct. 29, 2013

(86) PCT No.: PCT/JP2013/006402
§ 371 (c)(1),
(2) Date: Apr. 28, 2015

(87) PCT Pub. No.: WO2014/068963
PCT Pub. Date: May 8, 2014

(65) Prior Publication Data

US 2015/0267273 A1 Sep. 24, 2015

(30) Foreign Application Priority Data

Oct. 30, 2012 (JP) ..... 2012-239608

(51) Int. Cl.
*C21D 1/34* (2006.01)
*H01F 1/16* (2006.01)
(Continued)

(52) U.S. Cl.
CPC ..... *C21D 1/34* (2013.01); *C21D 8/12* (2013.01); *C21D 8/1244* (2013.01); *C21D 9/46* (2013.01);
(Continued)

(58) Field of Classification Search
CPC ..... H01F 1/16
See application file for complete search history.

(56) References Cited

U.S. PATENT DOCUMENTS 5,411,604 A * 5/1995 Inokuti ..... C21D 8/1294 148/112
2013/0130043 A1 5/2013 Omura
2014/0234638 A1 8/2014 Takajo

FOREIGN PATENT DOCUMENTS

JP 05335128 12/1993
JP 0622179 3/1994
(Continued)

OTHER PUBLICATIONS

IEEE Transactions on Magnetics, "Improvement of Magnetic Properties in Thinner HI-B with Domain-Refinement," vol. MAG-20, No. 5, Sep. 1984, p. 1557-1559.
(Continued)

*Primary Examiner* — Jophy S. Koshy
(74) *Attorney, Agent, or Firm* — RatnerPrestia

(57) ABSTRACT

A method of manufacturing a grain-oriented electrical steel sheet is provided. When irradiating the surface of a grain-oriented electrical steel sheet having a sheet thickness t with an electron beam in a direction intersecting a rolling direction, the irradiation energy E(t) of the electron beam is adjusted to satisfy Ewmin(0.23)×(1.61−2.83×t (mm))≤E(t) ≤Ewmin(0.23)×(1.78−3.12×t (mm)) (Expression (1)) using the value of the irradiation energy Ewmin(0.23) that minimizes iron loss for material with a sheet thickness of 0.23 mm.

3 Claims, 3 Drawing Sheets

(51) Int. Cl.

| | |
|---|---|
| ***C21D 8/12*** | (2006.01) |
| ***C21D 9/46*** | (2006.01) |
| ***H01F 41/04*** | (2006.01) |

(52) U.S. Cl.
CPC ..... *H01F 1/16* (2013.01); *H01F 41/04* (2013.01); *C21D 2201/05* (2013.01)

(56) References Cited

FOREIGN PATENT DOCUMENTS

| | | |
|---|---|---|
| JP | 2000328139 | 11/2000 |
| JP | 4705382 | 6/2011 |
| JP | 2011246782 | 12/2011 |
| JP | 2012001741 | 1/2012 |
| JP | 2012052230 | 3/2012 |
| JP | 2012177149 | 9/2012 |
| WO | 2013046716 | 4/2013 |

OTHER PUBLICATIONS

International Search Report dated Jan. 28, 2014 in International Application No. PCT/JP2013/006402.
Japanese Office action dated Apr. 1, 2014 in Japanese Application No. 2013-555499.
Extended European Search Report dated Oct. 23, 2015 for European Application No. 13851934.3-1362.

* cited by examiner

METHOD OF MANUFACTURING GRAIN-ORIENTED ELECTRICAL STEEL SHEET EXHIBITING LOW IRON LOSS

CROSS REFERENCE TO RELATED APPLICATIONS

This is the U.S. National Phase application of PCT/JP2013/006402, filed Oct. 29, 2013, which claims priority to Japanese Patent Application No. 2012-239608, filed Oct. 30, 2012, the disclosures of these applications being incorporated herein by reference in their entireties for all purposes.

TECHNICAL FIELD OF THE INVENTION

The present invention relates to a method of manufacturing a grain-oriented electrical steel sheet for use in an iron core of a transformer or the like.

BACKGROUND OF THE INVENTION

In recent years, energy use has become more efficient, and demand has emerged for a reduction in energy loss at the time of operation, for example in a transformer.

The loss occurring in a transformer is mainly composed of copper loss occurring in conducting wires and iron loss occurring in the iron core.

Iron loss can be further divided into hysteresis loss and eddy current loss. To reduce the former, measures such as improving the crystal orientation of the material and reducing impurities have proven effective. For example, JP 2012-1741 A (PTL 1) discloses a method of manufacturing a grain-oriented electrical steel sheet with excellent flux density and iron loss properties by optimizing the annealing conditions before final cold rolling.

On the other hand, in addition to reducing sheet thickness and increasing the added amount of Si, the eddy current loss is also known to improve dramatically by the formation of a groove or the introduction of strain on the surface of the steel sheet.

For example, JP H06-22179 B2 (PTL 2) discloses a technique for forming a linear groove, with a groove width of 300 μm or less and a groove depth of 100 μm or less, on one surface of a steel sheet so as to reduce the iron loss $W_{17/50}$, which was 0.80 W/kg or more before groove formation, to 0.70 W/kg or less.

JP 2011-246782 A (PTL 3) discloses a technique for irradiating a secondary recrystallized steel sheet with a plasma arc so as to reduce the iron loss $W_{17/50}$, which was 0.80 W/kg or more before irradiation, to 0.65 W/kg or less.

Furthermore, JP 2012-52230 A (PTL 4) discloses a technique for obtaining material for a transformer with low iron loss and little noise by optimizing the coating thickness and the average width of a magnetic domain discontinuous portion formed on the surface of a steel sheet by electron beam irradiation.

It is known, however, that the iron loss reduction effect achieved by such groove formation or introduction of strain differs depending on the sheet thickness of the material. For example, IEEE TRANSACTIONS ON MAGNETICS, VOL. MAG-20, NO. 5, p. 1557 (NPL 1) describes how, as the sheet thickness increases, the amount of reduction in iron loss due to laser irradiation tends to decrease and notes a difference of approximately 0.05 W/kg in the amount of reduction in iron loss ($\Delta W_{17/50}$) between sheet thicknesses of 0.23 mm and 0.30 mm for a material with a flux density of 1.94 T.

Against this background, studies have been made of whether the effect of reducing iron loss of thick sheet material can be improved even slightly by adjusting the magnetic domain refining method. For example, JP 2000-328139 A (PTL 5) and JP 4705382 B2 (PTL 6) disclose techniques for improving the effect of reducing iron loss of a grain-oriented electrical steel sheet from thick sheet material by optimizing the laser irradiation conditions in accordance with the sheet thickness of the material. In particular, PTL 6 discloses having obtained extremely low iron loss by setting the strain ratio η to 0.013 or less.

PATENT LITERATURE

PTL 1: JP 2012-1741 A
PTL 2: JP H06-22179 B2
PTL 3: JP 2011-246782 A
PTL 4: JP 2012-52230 A
PTL 5: JP 2000-328139 A
PTL 6: JP 4705382 B2

Non-Patent Literature

NPL 1: IEEE TRANSACTIONS ON MAGNETICS, VOL. MAG-20, NO. 5, p. 1557

SUMMARY OF INVENTION

A facility for magnetic domain refining of grain-oriented electrical steel sheets, however, not only needs to pass various types of steel sheets, such as sheets with a nominal sheet thickness of 0.20 mm, 0.23 mm, 0.27 mm, 0.30 mm, and the like, but should also preferably be a continuous sheet passage line from the perspective of improving production efficiency. Accordingly, in terms of practical operation, it is necessary to apply magnetic domain refining treatment continuously to a coil constituted by joining coils with different sheet thicknesses.

As described above, the magnetic domain refining conditions suitable for reducing iron loss can be considered to differ by sheet thickness. Therefore, around the portion where coils with different sheet thicknesses are joined, it is necessary to change the irradiation conditions of the laser or electron beam as quickly as possible in order to avoid a drop in productivity.

JP 4705382 B2 (PTL 6) shows that regardless of sheet thickness, iron loss is minimized at the portion where the strain ratio $(((\pi/8)w^2)/(t \cdot s))$ is approximately $2\times10^{-3}$, where w is the closure domain width, t is the sheet thickness, and s is the line spacing in the rolling direction (also referred to below as RD line spacing).

Accordingly, when the sheet thickness t is large, iron loss can be reduced by either shortening the RD line spacing or increasing the closure domain width.

Upon shortening the RD line spacing, however, productivity of course decreases. By simply calculating with t×s being constant, if the line specifications are for a line speed of 100 mpm with a sheet thickness of 0.23 mm at an RD line spacing of 5 mm, then upon increasing the sheet thickness to 0.30 mm, the line speed at an RD line spacing of 3.83 mm becomes 77 mpm, and productivity drops. Hence, to avoid a drop in productivity, it is preferable to use as large of a setting as possible for the line spacing, without any change due to the sheet thickness of the material.

On the other hand, the beam diameter and the irradiation energy per unit scanning length (acceleration voltage×beam current/scanning rate of beam on the steel sheet (referred to below simply as the scanning rate), or power/scanning rate) affect the closure domain width. In particular, a smaller beam diameter is preferable for reducing iron loss in the steel sheet, regardless of the sheet thickness. Therefore, the condition yielding the smallest possible beam diameter is preferably always used as a fixed condition.

When changing the acceleration voltage, it is necessary at the same time to readjust various beam conditions, such as the optical system and the focusing conditions. Therefore, frequent changes lead to a significant reduction in production volume and are not preferable.

Furthermore, since the scanning rate greatly affects productivity, the maximum value is preferably adopted at all times regardless of sheet thickness.

Accordingly, for line operation that yields maximum productivity, the closure domain width is most preferably adjusted based only on the power (the beam current in the case of an electron beam).

The present invention has been conceived in light of the above circumstances and proposes a method of manufacturing a grain-oriented electrical steel sheet with high productivity in order to improve the magnetic properties of a grain-oriented electrical steel sheet using electron beam irradiation. By not requiring adjustment of the optical system, such as the beam diameter of the electron beam, and not requiring shortening of the line spacing even for thick sheet material, this method can suppress a reduction in productivity caused by shortening of line spacing.

The inventors of the present invention conjectured that the technique used in a laser method could also be applied to an electron beam method and therefore, in an attempt to reduce iron loss, investigated the relationship between the strain ratio $(((\pi/8)w^2)/(t\ s))$ and iron loss. The inventors adjusted the strain ratio $(((\pi/8)w^2)/(t\ s))$ only by changing the beam current.

FIG. 1 shows the effect of the strain ratio $\eta$ (listed in PTL 6) on the iron loss after electron beam irradiation for material with a sheet thickness of 0.20 mm and 0.23 mm. As shown in PTL 6, iron loss tends to worsen when the strain ratio is either too high or too low. The results of the above investigation show that although the beam diameter is a fixed condition, the strain ratio yielding the minimum iron loss was in a region of 0.013 or more, contrary to conventional wisdom. Furthermore, the strain ratio yielding the minimum iron loss varied by sheet thickness.

The inventors assumed that the above results were affected by a difference in principle between the electron beam method and the laser method and posited that, in the case of the electron beam method, a method for adjustment by sheet thickness exists, unlike with the laser method.

Therefore, the inventors returned again to the basics and reinvestigated, in detail for each sheet thickness, the relationship between the effect of reducing iron loss and the irradiation energy for the electron beam method. The measurement results are shown in FIGS. 2(*a*) to 2(*c*). The inventors changed the irradiation energy only by adjusting the beam current.

Close examination of the investigation results indicated that, contrary to conventional wisdom, for an electron beam method in which only the beam current is adjusted, the appropriate irradiation energy needs to be reduced as the sheet material is thicker. The reason is that when contemplating iron loss separately as hysteresis loss and eddy current loss, hysteresis loss worsens to a lesser degree and the improvement in eddy current loss is greater as the sheet material is thinner. In particular, a large change in hysteresis loss was observed from a 0.23 mm material to a 0.20 mm material, i.e. upon thinning of the sheet.

Based on the results illustrated in FIG. 2 (illustrating the relationship between irradiation energy and $\Delta W_{17/50}$), the inventors investigated the effect of sheet thickness on the appropriate irradiation energy. The relationship between material with a thickness of 0.23 mm and the amount of change in irradiation energy is as shown in FIG. 3. Letting the appropriate energy range at each sheet thickness (t) be ±5% of the value Ewmin(t) at which the iron loss is minimized, as calculated from the data in FIG. 2 (illustrating the relationship between irradiation energy and $\Delta W_{17/50}$), the upper and lower limits on the irradiation energy in FIG. 3 were calculated as an amount of change from the appropriate energy Ewmin(0.23) at which the iron loss is minimized for material with a thickness of 0.23 mm. The attained iron loss exhibits almost no variation over the range of ±5%.

Specifically, the inventors newly discovered that it is important for the appropriate irradiation energy to satisfy the following relationship:

$$-283\times t\ (\text{mm})+61 \leq [\text{amount of change in appropriate irradiation energy from 0.23 mm material}](\%) \leq -312\times t\ (\text{mm})+78.$$

Furthermore, based on the above finding that the appropriate irradiation energy is lower for thick sheet material, the inventors posited that when the irradiation energy per unit scanning length is not changed, the RD line spacing s(t) should preferably be widened. In other words, the inventors newly discovered that in conjunction with the effect of the amount of energy irradiated per unit area (E/s) on iron loss, smin(0.23) and s(t) preferably satisfy a predetermined relationship.

The present invention is based on the above-described findings.

Specifically, primary features of the present invention include the following.

1. A method of manufacturing a grain-oriented electrical steel sheet, the method comprising:

when irradiating a surface of a grain-oriented electrical steel sheet having a sheet thickness t with an electron beam in a direction intersecting a rolling direction, adjusting an irradiation energy E(t) of the electron beam to satisfy $$Ewmin(0.23)\times(1.61-2.83\times t\ (\text{mm})) \leq E(t) \leq Ewmin(0.23)\times(1.78-3.12\times t\ (\text{mm})) \quad \text{(Expression (1))},$$

wherein Expression (1) takes a value of an irradiation energy Ewmin(0.23) that minimizes iron loss for material with a sheet thickness of 0.23 mm.

2. The method of 1., wherein the sheet thickness t is 0.23 mm or less.

3. A method of manufacturing a grain-oriented electrical steel sheet, the method comprising:

when irradiating a surface of a grain-oriented electrical steel sheet having a sheet thickness t of 0.23 mm or more with an electron beam in a direction intersecting a rolling direction, adjusting a line spacing s(t) of the electron beam to satisfy $smin(0.23)/(1.78-3.12\times t\ (\text{mm})) \leq s(t) \leq smin(0.23)/(1.61-2.83\times t\ (\text{mm}))$ (Expression (2)) with respect to a line spacing smin(0.23) that minimizes iron loss for material with a sheet thickness of 0.23 mm.

According to the present invention, magnetic domain refining can be performed appropriately on a grain-oriented electrical steel sheet of any sheet thickness without adjusting the beam diameter or line spacing of the electron beam and while always using an extremely small beam. It is thus possible to suppress a reduction in productivity caused by an increase in time for adjusting the optical system or by shortening of line spacing, which were unavoidable with conventional techniques. Furthermore, magnetic domain refining can be performed appropriately on thick sheet material by increasing only the line spacing, without adjusting the electron beam power, thereby allowing for manufacturing of a grain-oriented electrical steel sheet with high productivity.

BRIEF DESCRIPTION OF DRAWINGS

Embodiments of the present invention will be further described below with reference to the accompanying drawings, wherein.

DESCRIPTION OF EMBODIMENTS OF THE INVENTION

The present invention will be described in detail below with reference to exemplary embodiments.

The present invention provides a method of manufacturing a grain-oriented electrical steel sheet by irradiation with an electron beam in order to reduce iron loss. An insulating coating may be formed on the electrical steel sheet irradiated with an electron beam, yet omitting the insulating coating poses no problem. The present invention may be applied to any conventionally known grain-oriented electrical steel sheet, for example regardless of whether inhibitor components are included.

Figure 1:
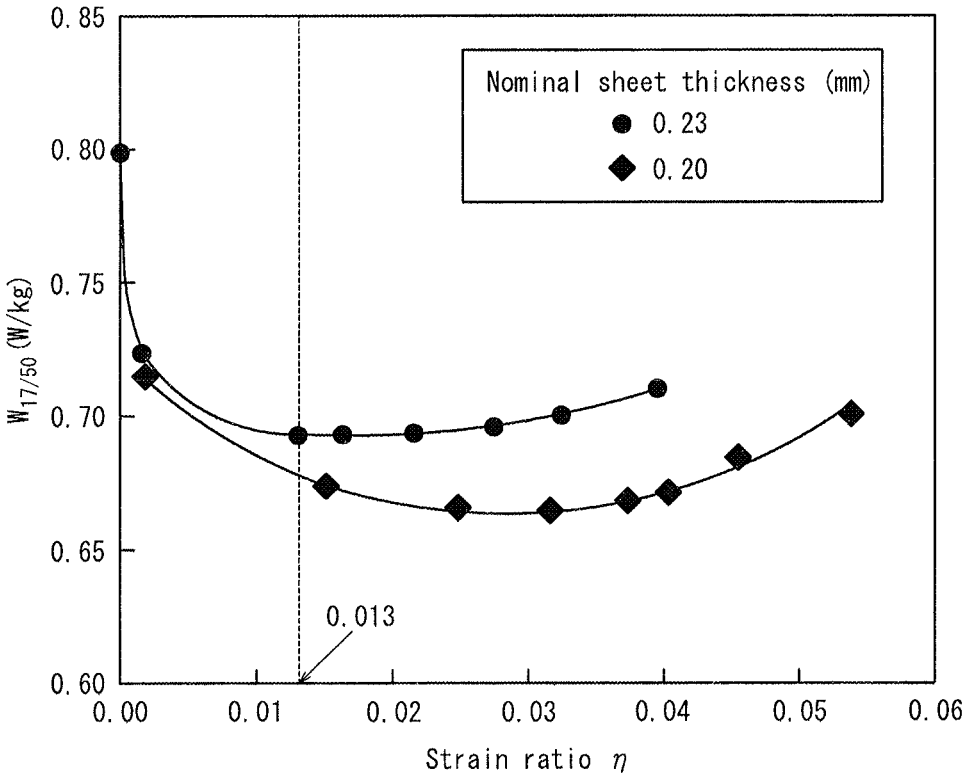
FIG. 1 illustrates the effect of the strain ratio η on the iron loss after electron beam irradiation of materials with a sheet thickness of 0.20 mm and of 0.23 mm.
Figure 2A:
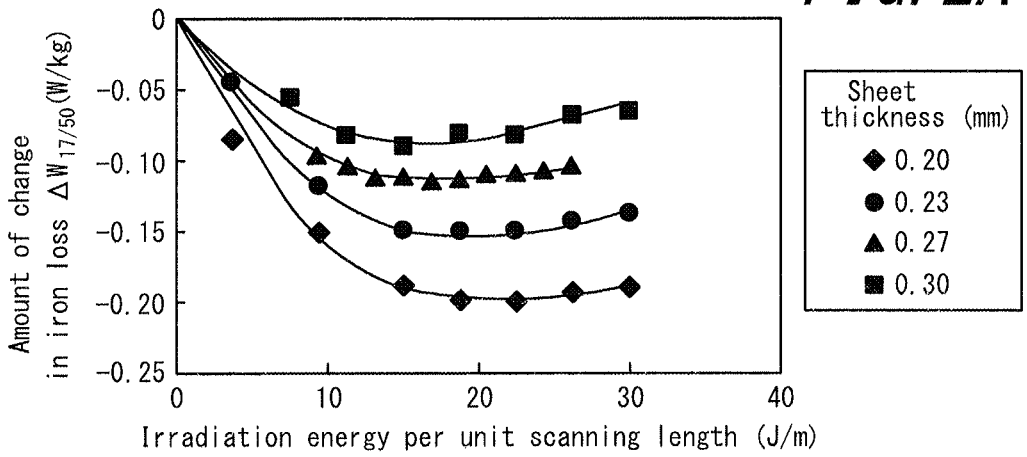
FIG. 2(*a*) illustrates the relationship between irradiation energy and the amount of change in iron loss for an electron beam method, FIG. 2(*b*) the relationship between irradiation energy and the amount of change in hysteresis loss for an electron beam method, and FIG. 2(*c*) the relationship between irradiation energy and the amount of change in eddy current loss for an electron beam method, each figure showing the investigation results for each sheet thickness.
Figure 2B:
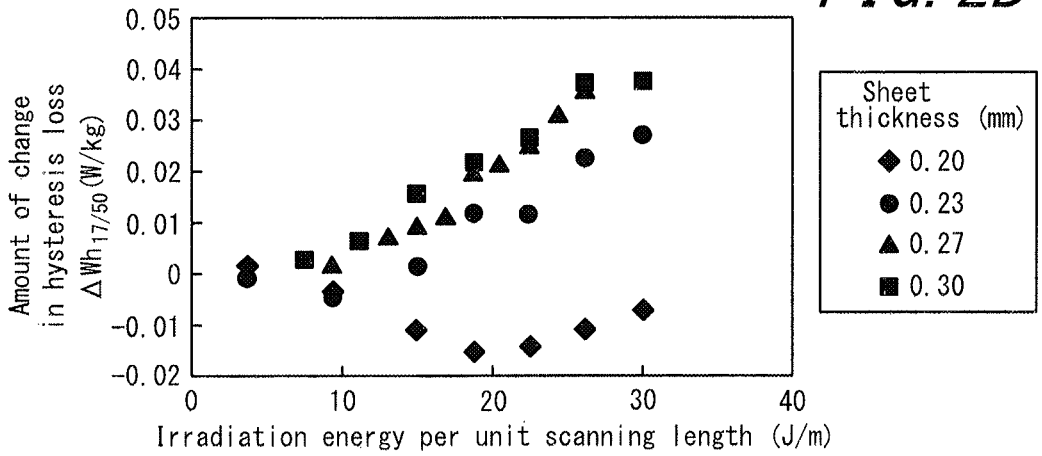
Figure 2C:
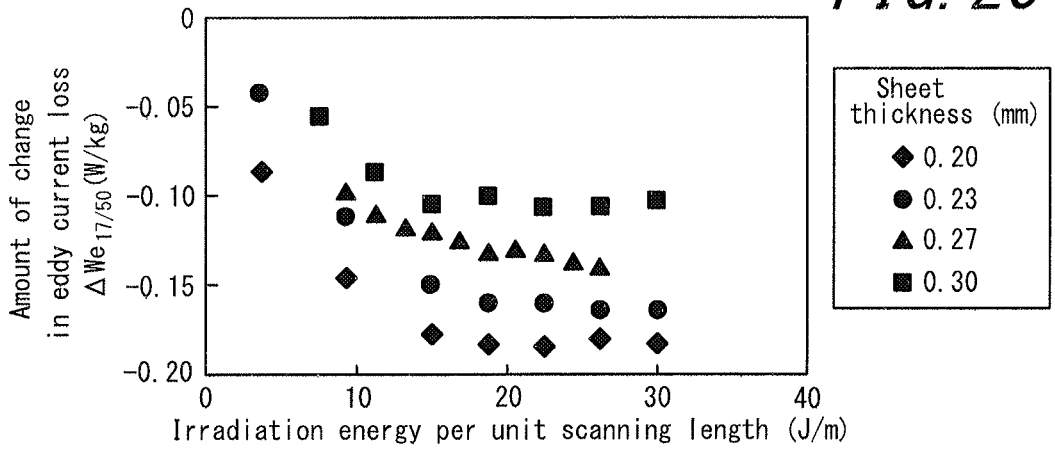
Figure 3:
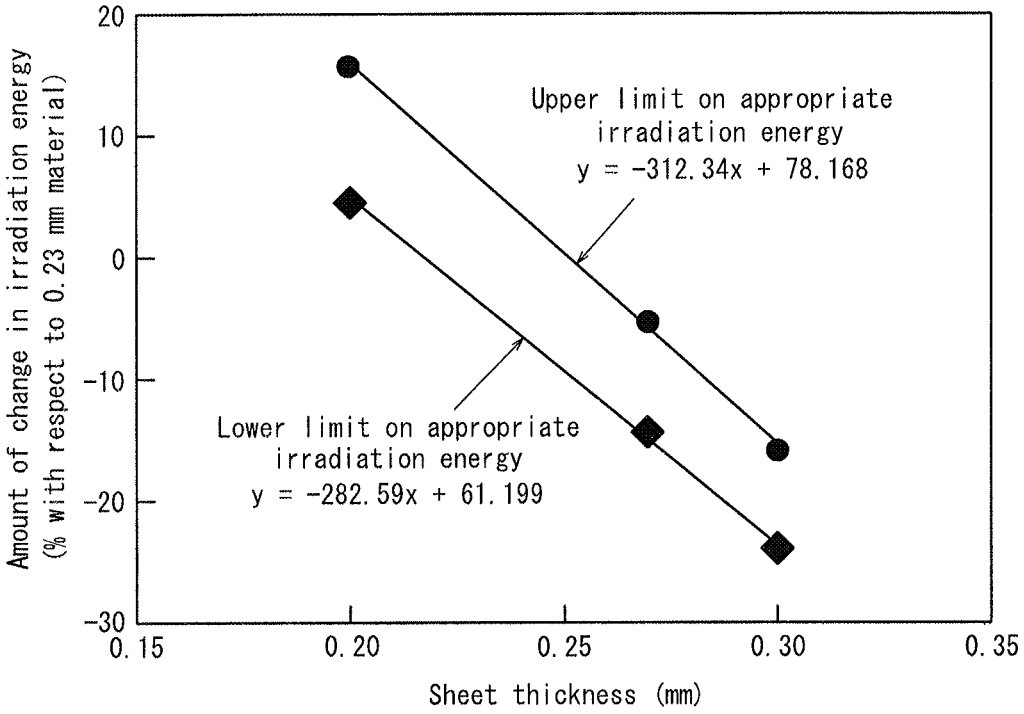
FIG. 3 illustrates the results of investigation into the effect of sheet thickness on the appropriate irradiation energy.

Based on the results illustrated in FIGS. 2(*a*) to 2(*c*) and FIG. 3, in the present invention the appropriate energy range at each sheet thickness (t) is set to ±5% of the value Ewmin(t) at which the iron loss is minimized. The reason is that in this range of ±5% of Ewmin(t), the attained iron loss exhibits almost no variation. In this context, energy refers to the irradiation energy per unit scanning length and can be expressed as beam power/scanning rate.

Next, using the results illustrated in FIGS. 2(*a*) to 2(*c*) and FIG. 3, the irradiation energy was calculated as an amount of change from the appropriate energy Ewmin(0.23) at which the iron loss is minimized for material with a thickness of 0.23 mm as follows:

$$-283\times t\ (\text{mm})+61\leq[\text{amount of change in appropriate irradiation energy from 0.23 mm material}](\%)\leq-312\times t\ (\text{mm})+78.$$

Using the expression above to calculate the appropriate energy range E(t) at each sheet thickness (t) yields Expression (1) below.

$$Ewmin(0.23)\times(1.61-2.83\times t\ (\text{mm}))\leq E(t)\leq Ewmin(0.23)\times(1.78-3.12\times t\ (\text{mm})) \quad \text{(Expression (1))}$$

Accordingly, without adjusting the beam diameter or line spacing of the electron beam, satisfying Expression (1) allows for suppression of a reduction in productivity caused by optical system adjustment operations or by shortening of line spacing.

The reason why Expression (1) is preferably applied to a steel sheet of 0.23 mm or less is that, as described below, for a thickness of 0.23 or more, reducing iron loss by increasing the line spacing is advantageous from the perspective of productivity.

Furthermore, in the case of thick sheet material that is 0.23 mm or more, based on the results in the above-described FIGS. 2(*a*) to 2(*c*) and FIG. 3, the RD line interval s(t) is preferably widened, and in conjunction with the effect of the amount of energy irradiated per unit area (E/s) on iron loss, Expression (2) below is preferably satisfied.

$$s\ \min(0.23)/(1.78-3.12\times t\ (\text{mm}))\leq s(t)\leq s\ \min(0.23)/(1.61-2.83\times t\ (\text{mm})) \quad \text{(Expression (2))}$$

In the present invention, the preferable generation conditions for the electron beam are as follows.

[Acceleration Voltage Va: 30 kV to 300 kV]

If the acceleration voltage Va falls below 30 kV, it becomes difficult to focus the beam diameter, and the effect of reducing iron loss is lessened. Conversely, an acceleration voltage Va exceeding 300 kV not only shortens the life of the equipment, such as the filament, but also causes the size of a device for preventing x-ray leakage to increase excessively, thus reducing maintainability and productivity. Accordingly, the acceleration voltage Va is preferably in a range of 30 kV to 300 kV.

[Beam Diameter: 50 μm to 500 μm]

If the electron beam diameter is less than 50 μm, measures must be taken such as dramatically reducing the distance between the steel sheet and the deflection coil. In this case, the distance at which deflection irradiation with one electron beam source is possible is greatly reduced. As a result, in order to irradiate a wide coil of about 1200 mm, multiple electron guns become necessary, reducing maintainability and productivity.

Conversely, if the beam diameter exceeds 500 μm, a sufficient effect of reducing iron loss cannot be obtained. The reason is that the area of the steel sheet irradiated by the beam (the volume of the portion where strain is formed) increases excessively, and hysteresis loss worsens.

Accordingly, the electron beam diameter is preferably in a range of 50 μm to 500 μm. Note that the full width at half maximum of the beam profile obtained by a slit method was measured as the beam diameter.

[Beam Scanning Rate: 20 m/s or More]

If the beam scanning rate is less than 20 m/s, the production volume of steel sheets decreases. Accordingly, the beam scanning rate is preferably 20 m/s or more. While there is no restriction on the upper limit of the beam scanning rate, in terms of equipment constraints, an upper limit of approximately 1000 m/s is realistic.

[RD Line Spacing: 3 mm to 12 mm]

In the present invention, the steel sheet is irradiated with the electron beam in a straight line from one edge in the width direction to the other edge, and the irradiation is repeated periodically in the rolling direction. The spacing (line spacing) is preferably 3 mm to 12 mm. The reason is that if the line spacing is narrower than 3 mm, the strain region formed in the steel becomes excessively large, and not only does iron loss (hysteresis loss) worsen, but also productivity worsens. On the other hand, if the line spacing is wider than 12 mm, the magnetic domain refining effect lessens no matter how much the closure domain extends in the depth direction, and iron loss does not improve.

[Line Angle: 60° to 120°]

In the present invention, when irradiating the steel sheet with the electron beam in a straight line from one edge in the width direction to the other edge, the direction from the starting point to the ending point is set to be from 60° to 120° with respect to the rolling direction. The reason is that upon deviating from a direction of 60° to 120°, the volume of the portion where strain is introduced increases excessively, and hysteresis loss worsens. The direction is preferably 90° with respect to the rolling direction.

[Processing Chamber Pressure: 3 Pa or Less]

The reason for this range is that if the pressure of the processing chamber for irradiating with an electron beam is higher than 3 Pa, electrons emitted from the electron gun scatter, and the energy of the electrons forming the closure domain in the portion irradiated by the electron beam is reduced. As a result, the magnetic domain of the steel sheet is not sufficiently refined, and iron loss properties do not improve.

[Beam Focusing]

When irradiating by deflecting the electron beam in the width direction of the steel sheet, the focusing conditions (focusing current and the like) are of course preferably adjusted in advance to optimal conditions so that the beam is uniform in the width direction.

EXAMPLES

In the present examples, four 1500 m grain-oriented electrical steel sheet coils at each nominal sheet thickness (t) of 0.23 mm, 0.27 mm, 0.30 mm, and 0.20 mm were joined tip to tail and subjected to electron beam irradiation.

The electron beam irradiation was performed under the conditions of an acceleration voltage of 60 kV, beam diameter of 250 beam scanning rate of 90 m/s, line angle of 90°, and processing chamber pressure of 0.1 Pa, and the electron beam irradiation time for each coil was recorded. Note that 4 m at the tip/tail portion of the coil of each sheet thickness were designated as a region not subjected to electron beam irradiation (non-irradiated portion).

After irradiation, 60 SST samples each were taken from the portion subjected to electron beam irradiation (irradiated portion) and the non-irradiated portion in the coil of each sheet thickness, and iron loss was measured.

Table 1 lists electron beam irradiation conditions along with the measurement results for iron loss.

TABLE 1

| No. | RD line spacing | Irradiation energy per unit scanning length | Iron loss $W_{17/50}$(W/kg) (upper tier: non-irradiated portion; lower tier: irradiated portion) 0.23 mm | 0.27 mm | 0.30 mm | 0.20 mm | Coil irradiation time (min) 0.23 mm | 0.27 mm | 0.30 mm | 0.20 mm | Total irradiation time (min) | Notes |
|---|---|---|---|---|---|---|---|---|---|---|---|---|
| 1 | Fixed at 5 mm | Fixed at Ewmin(0.23) | 0.837/ 0.693 | 0.847/ 0.758 | 0.946/ 0.860 | 0.840/ 0.668 | 25 | 25 | 25 | 25 | 100 | Conventional example |
| 2 | Fixed at 5 mm | Expression (1) applied | 0.837/ 0.693 | 0.847/ 0.754 | 0.946 0.852 | 0.840/ 0.663 | 25 | 25 | 25 | 25 | 100 | Inventive example |
| 3 | Expression (2) applied | Fixed at Ewmin(0.23) | 0.837/ 0.693 | 0.847/ 0.752 | 0.946/ 0.852 | 0.840/ 0.669 | 25 | 21 | 19 | 25 | 90 | Inventive example |

Table 1 shows that applying the present technique yielded a maximum improvement of nearly 1% in iron loss for material with a thickness of 0.20 mm, 0.27 mm, and 0.30 mm under conditions that use the beam current to optimize the irradiation energy for each sheet thickness (No. 2).

It is also clear that the present technique yielded a maximum improvement of nearly 1% in iron loss for material with a thickness of 0.27 mm and 0.30 mm under conditions that use line spacing to optimize the irradiation energy (No. 3) and furthermore achieved excellent productivity by reducing the irradiation time by nearly 10%.

The invention claimed is:

1. A method of manufacturing a grain-oriented electrical steel sheet, the method comprising:

measuring a thickness t, in millimeters, and a flux density of a first steel sheet;

determining an irradiation energy per unit scanning length Ewmin(0.23), in Joules per meter, of a second steel sheet having a thickness of 0.23 millimeters that produces a minimum amount of iron loss from the second steel sheet, the flux density of the second steel sheet being the same as the flux density of the first steel sheet;

adjusting an irradiation energy per unit scanning length E(t), in Joules per meter, of an electron beam to satisfy the following Expression (1) for the first steel sheet, $$Ewmin(0.23)\times(1.61-2.83\times t)\leq E(t)\leq Ewmin(0.23)\times(1.78-3.12\times t) \quad \text{Expression (1); and}$$

thereafter irradiating a surface of the first a-steel sheet to obtain a grain-oriented electrical steel sheet from the first steel sheet with an adjusted electron beam in a direction intersecting a rolling direction.

2. The method of claim 1, wherein the sheet thickness t is 0.23 mm or less.

3. A method of manufacturing a grain-oriented electrical steel sheet, the method comprising:

measuring a thickness t, in millimeters, and a flux density of a first steel sheet, wherein the thickness t of the first steel sheet is 0.23 mm or more;

determining a line spacing smin(0.23), in millimeters, for a second steel sheet having a thickness of 0.23 millimeters that produces a minimum amount of iron loss from the second steel sheet, the flux density of the second steel sheet being the same as the flux density of the first steel sheet;

adjusting a line spacing s(t) in millimeters of an electron beam to satisfy the following Expression (2), $$s\ \min(0.23)/(1.78-3.12\times t)\leq s(t)\leq s\ \min(0.23)/(1.61-2.83\times t) \quad \text{Expression (2); and}$$

thereafter irradiating a surface of the first steel sheet to obtain a grain-oriented electrical steel sheet from the first steel sheet with an adjusted electron beam in a direction intersecting a rolling direction.

* * * * *